United States Patent [19]

Roehl

[11] Patent Number: 4,775,152

[45] Date of Patent: Oct. 4, 1988

[54] HOCKEY TYPE GAME

[76] Inventor: Darrell Roehl, 15947 Island View Rd., Prior Lake, Minn. 55372

[21] Appl. No.: 95,211

[22] Filed: Sep. 11, 1987

[51] Int. Cl.[4] ..... A63F 7/06

[52] U.S. Cl. ..... 273/85 R; 273/118 R; 273/126 R

[58] Field of Search ..... 273/85 R, 118 R, 126 R

[56] References Cited

U.S. PATENT DOCUMENTS

| | | | |
|---|---|---|---|
| 545,246 | 8/1895 | McCordy | 273/118 R |
| 1,195,173 | 8/1916 | Beamer et al. | 273/118 R |
| 1,593,421 | 7/1926 | Blum | 273/85 R |
| 2,969,985 | 1/1961 | Batt | 273/85 R X |
| 3,042,407 | 7/1962 | Gorgol | 273/126 R |
| 4,166,620 | 9/1979 | Sheppard | 273/85 R X |

FOREIGN PATENT DOCUMENTS

| | | | |
|---|---|---|---|
| 14081 | 12/1913 | United Kingdom | 273/85 R |

*Primary Examiner*—Anton O. Oechsle

*Attorney, Agent, or Firm*—Palmatier & Sjoquist

[57] ABSTRACT

A hockey-type game as disclosed wherein the players attempt to propel a playing piece into the opposing players' diagonally positioned goal opening and further including a plurality of inner walls extending inwardly from the side and end walls and including a centrally positioned diamond shaped central wall arrangement wherein a plurality of the inner walls include passageways therein. In one embodiment the playing surface is attached to the outer wall while in the more versatile embodiment, the game may be placed on any hard, flat surface.

5 Claims, 2 Drawing Sheets

HOCKEY TYPE GAME

FIELD OF THE INVENTION

The present invention relates generally to game boards and more particularly to hockey-type game boards having various obstacles located between the goals.

DESCRIPTION OF THE PRIOR ART

Hockey-type game boards are generally known in the art. Modifications of such games are similarly known. One example of a hockey-type game board is disclosed in U.S. Pat. No. 4,023,150 issued to Wilson on June 28, 1977. The Wilson patent discloses a rectangular hockey-type game board having a plurality of goals on each end. Additionally, the Wilson Patent discloses the use of rubber materials such as Neoprene to deaden the sound of the game and to increase the rebounding of the puck.

Another hockey-type game board is disclosed in U.S. Pat. No. 4,166,620 issued to Sheppard on Sept. 4, 1979. The Sheppard patent discloses a table top fingertip hockey game. One embodiment disclosed in the Sheppard patent includes the use of adjustable inner walls. Sheppard's use of adjustable inner walls requires that the playing surface have numerous apertures located thereon. In this embodiment, the playing surface is preferably constructed of a material such as peg board so that pegs located on the bottom of the inner walls may be removably inserted into the openings to create a variety of game board configurations.

DESCRIPTION OF THE PREFERRED EMBODIMENTS

Figure 1:
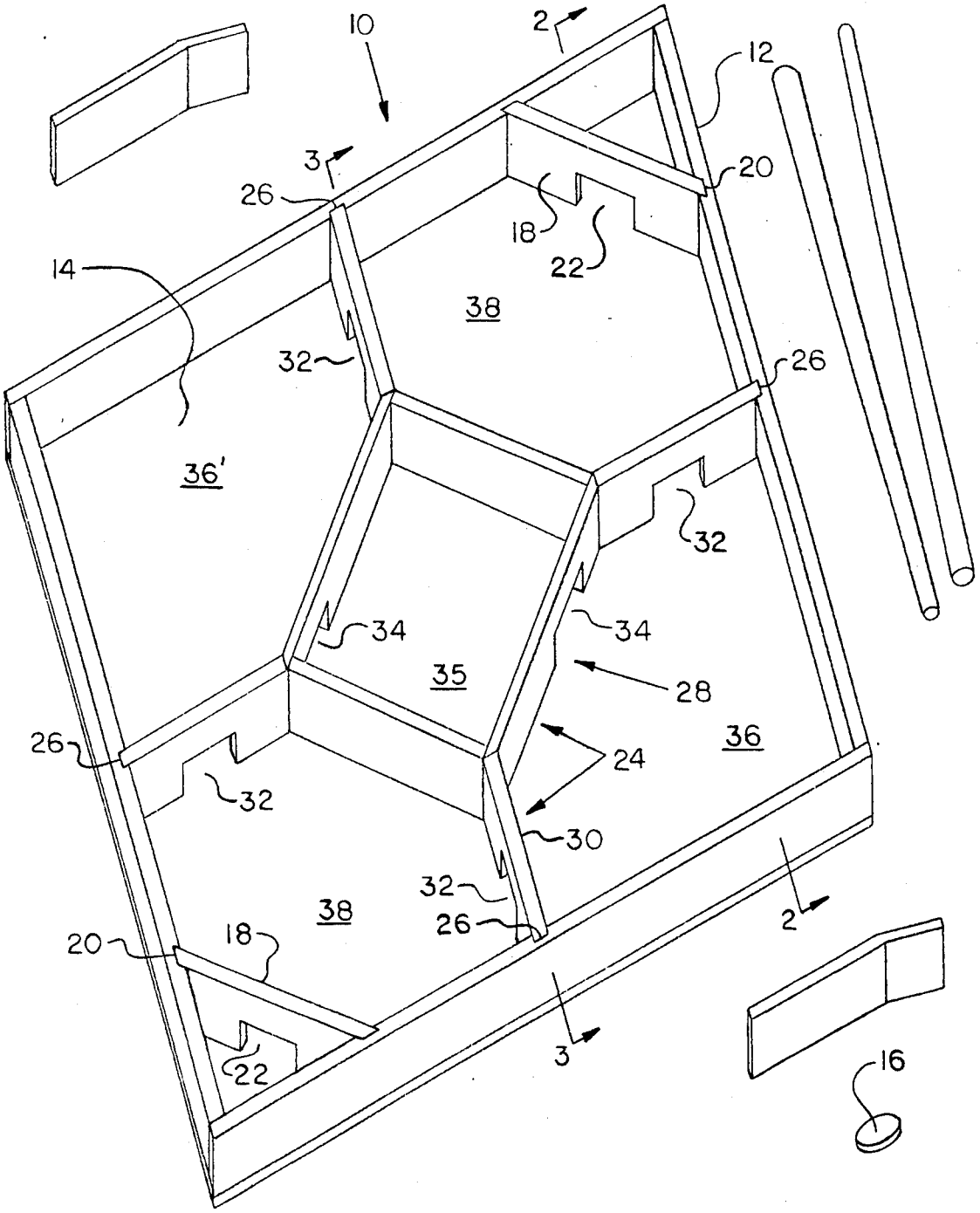
FIG. 1 is a perspective view of the present invention.
Figure 2:
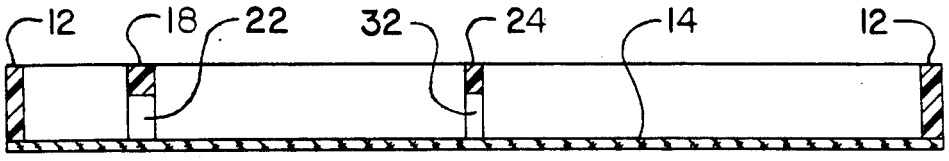
FIG. 2 is a cross sectional view of the invention taken along line 2—2 of FIG. 1.
Figure 3:
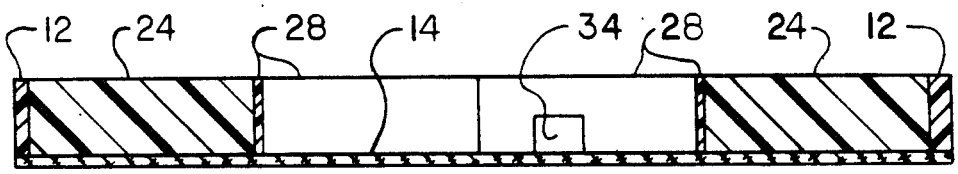
FIG. 3 is a cross-sectional view of the invention taken along line 3—3 of FIG. 1.

Referring to FIG. 1, the hockey-type game of the present invention is illustrated and comprises a game board 10 which is bordered by an outer wall 12. The game 10 and outer wall 12 are preferably molded as a single piece of molded plastic; however, plywood or other materials may be used as long as the playing surface 14 is smooth and sufficiently sturdy to provide a minimum amount of resistance to the playing piece 16 as it travels over the playing surface 14. The playing piece 16 is preferably shaped like a hockey puck although a rubber ball may also be used. The game board 10 is preferably square and the outer walls 12 extend upwardly approximately 4 inches from the playing surface 14.

The outer walls 12 extend perpendicularly from the game board surface 10 to encircle the entire playing area. A pair of goal walls 18 are opposingly located diagonally across two of the corners formed by the outer walls 12. The goal walls 18 are preferably formed of plastic and removably insert into vertical slots 20 located on the outer walls 12. The goal walls 18 may also be constructed of wood or other materials and may be permanently affixed to the outer walls 12 by gluing or molding. The goal walls 18 include centrally located goal openings 22 approximately 4 inches wide and 2 inches high along their lower surface. If removable goal walls 18 are used, various sized goal openings 22 may be utilized to enable players of differing abilities to competitively play against each other.

The use of diagonal goal walls 18 overcomes one frequent area of disagreement between players. This occurs when the playing piece 16 passes through the goal opening 22 and immediately deflects back onto the playing surface 14. Frequently, one player will argue that the playing piece 16 never passed through the goal opening 22. In the present invention, when the playing piece 16 passes through the goal opening 22, it contacts the outer wall 12 at an angle and caroms against the outer walls 12 and inner surface of the goal wall 18 rather than returning back onto the playing surface 14.

In the invention illustrated in FIG. 1, the inner walls described generally as 24, are attached to each of the outer walls 12, and as with the goal walls 18, the inner walls 24 are removably attached to the outer walls 12 using vertical slots 26. These vertical slots 26 are located midway along each outer wall 12 and enable the configuration of the inner walls 24 to be changed whenever the players desire a different game board. It has been found that one of the most challenging game board configurations consists of inner walls 24 comprising a diamond shaped central wall arrangement 28 and border walls 30 extending from the corners of the diamond to the outer walls 12. Each border wall 30 has a centrally positioned passageway 32 to enable the playing piece 16 to be shot through the respective border wall 30. The walls of the central wall arrangement 28 facing the goal walls 18 are solid to prevent direct shots into the goal openings 22. The only outlet for the playing piece 16 from the central wall arrangement 28 are passageways 34 located on the central walls 28 facing the neutral zones 36. These passageways 34 are aligned so that the playing piece 16 is unlikely to pass through both passageways 34 in one shot.

The use of the central wall arrangement 28 creates a game which typically flows in a circular pattern along the outer walls 12. The playing piece 16 is initially dropped in the center zone 35 inside the central wall arrangement 28 and play begins with both players attempting to simultaneously move the playing piece 16. The playing piece 16 ultimately passes through one of the passageways 34 and into a neutral zone 36. The neutral zone 36 is surrounded by a pair of border walls 30 and a pair of outer walls 12. The playing piece then passes through one of these passageways 32 and into one of the goal zones 38. Once the playing piece 16 is in the goal zone 38, it is frequently hit into the second neutral zone 36' if a goal is not scored. This type of movement wherein the playing piece 16 passes from one neutral zone 36 to the second neutral zone 36' is frequently repeated. It has been observed that during the normal course of a game, the playing piece 16 is in the neutral zone 36 more than it is in the goal zone 38; however, this observation is entirely dependent on the comparative skills of each player.

Figure 4:
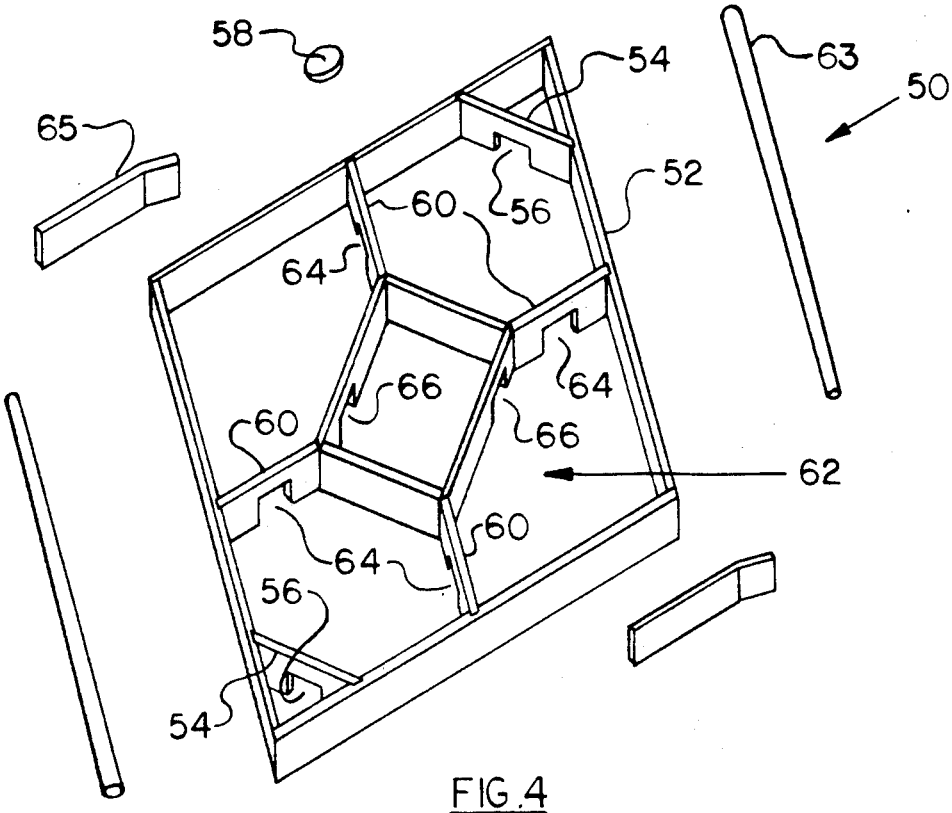
FIG. 4 is a perspective view of a modification of the present invention.

Another, more versatile, form of the invention is illustrated in FIG. 4. This game board 50 is designed for use in basements, garages or outdoors on driveways or patios. The outer walls 52 provide the primary means of support for the structure and may be constructed of wood or plastic. The goal walls 54 are diagonally located at opposing corners of the game board 50 and are nailed or glued to the outer walls 52. Goal openings 56 are centrally located along the goal walls 54 and are preferably 3 inches high and 4 inches wide to enable the players to use hockey pucks or small balls as playing pieces 58. Border walls 60 are attached to each outer wall 52 at the midpoint of each outer wall 52. Each border wall 60 extends inwardly from the outer wall 52 to contact the corners of the diamond shaped, central wall arrangement 62. As with the previously described embodiment, the border walls 62 and two of the central walls 62 include passageways 64 and 66, respectively.

This embodiment does not include the fixed playing surface 14 illustrated in FIG. 1 and therefore is lighter and more easily transported to a suitable playing location. Additionally, it is anticipated that the outer walls 52 may include hinges (not shown) near the border walls 62 to enable the game board 50 to be folded for compact storage or transport.

Two versions of this game have been developed by the applicant. The first version involves a use of elongate sticks 63 such as broom stick handles and emphasizes the speed and agility of the players. In this first version, the players align themselves opposite each other along the outer walls 12 so that the goal wall 18 nearest them on is on their right hand side. The players must remain along their respective outer wall 12 throughout the game. The playing piece 16 is initially placed in the middle of the central wall arrangement 28 and the game begins on a predetermined signal. Both players simultaneously attempt to move the playing piece 16 through the passageways 32 and 34 towards their opponents' goals by hitting the playing piece 16 with their sticks 63. Play continues with each player attempting to move the playing piece 16 until a predetermined number of goals have been scored. In this version, the players are not allowed to block the goals with their sticks 63, and, therefore, this version is very offense oriented.

The second version of this game is a slower version which emphasizes the accuracy of each player's shots and involves more strategy than is necessary with the first version. In this second version, the players use rectangular paddles 65 similar to hockey stick blades to alternate shooting the playing piece 16 towards their opponents' goal. The emphasis in this version of the game is on the player's ability to accurately carom the playing piece 16 off the various walls towards their opponents' goal. By using the preferred central wall arrangement 28, the players are unable to take direct shots at their opponents' goal and therefore each player must strategically move the playing piece 16 towards the opponents' goal while preventing their opponent from having direct shots at their own goal. As with the first version of this game, the game ends when one of the players scores a predetermined number of goals.

It will be appreciated by those skilled in the art that the foregoing is intended to be illustrative of an embodiment of the invention and the scope of the invention is to be determined by the claims. It is anticipated that variations in the respective sizes and shapes of the border walls 30 and central wall arrangement 28 are apparent from the foregoing description and are, therefore, incorporated herein.

What is claimed is:

1. A hockey type game, comprising (a) a raised outer wall defined by a pair of parallel, spaced apart, opposed end walls secured to a pair of parallel, spaced apart, opposed side walls to form a plurality of corners on said outer wall, (b) a plurality of border walls having inner and outer ends, said outer ends attached to and extending inwardly from said end walls and side walls, (c) a plurality of inner walls arranged to form a polygonal central wall arrangement, (d) said inner walls being attached to the inner ends of the border walls, (e) said border walls and inner walls having a plurality of passageways therein to allow the passage of a playing piece therethrough, (f) a pair of goal walls extending across opposing corners of said outer walls, (g) said goal walls having passageways therein to allow the passage of a playing piece therethrough, (f) said inner walls and border walls being positioned inside the outer walls to obstruct the passage of a playing piece between the opposed end walls.

2. The game according to claim 1, wherein the raised outer walls define a square.

3. The game of claim 1, wherein the raised outer walls are attached to a playing board having a top playing surface which is smooth and flat and over which a playing piece is propelled.

4. The game according to claim 1, wherein the outer walls include vertical slots for the removable attachment of said border walls and goal walls.

5. The game according to claim 1, wherein the goal walls extend diagonally across the corners of said outer walls.

* * * * *